US006371482B1

(12) United States Patent
Hall, Jr.

(10) Patent No.: US 6,371,482 B1
(45) Date of Patent: Apr. 16, 2002

(54) METHOD AND APPARATUS FOR GENERATING NUMBERS TO PLAY IN A LOTTERY BASED ON ASTRONOMICAL EVENTS

(76) Inventor: Edgar Robert Hall, Jr., 1003 Carlisle Rd., Stone Mtn., GA (US) 30083

( * ) Notice: Subject to any disclaimer, the term of this patent is extended or adjusted under 35 U.S.C. 154(b) by 0 days.

(21) Appl. No.: 09/627,040

(22) Filed: Jul. 27, 2000

(51) Int. Cl.[7] ..... A63F 3/06

(52) U.S. Cl. ..... 273/138.1; 273/138.2; 273/139; 273/148 R; 463/17; 463/16

(58) Field of Search ..... 273/161, 138.1, 273/138.2, 139, 148 R, 269; 463/17, 18, 19, 16

(56) References Cited

U.S. PATENT DOCUMENTS

| | | | | |
|---|---|---|---|---|
| 4,692,863 A | | 9/1987 | Moosz | |
| 5,110,129 A | | 5/1992 | Alvarez | |
| 5,118,110 A | * | 6/1992 | Jones | 273/141 R |
| 5,197,736 A | * | 3/1993 | Backus et al. | 273/142 R |
| 5,203,564 A | * | 4/1993 | Bruzas | 273/161 |
| 6,146,272 A | * | 11/2000 | Walker et al. | 463/17 |

FOREIGN PATENT DOCUMENTS

| | | |
|---|---|---|
| FR | 2616677 | * 12/1988 |
| GB | 2309915 | * 8/1997 |

OTHER PUBLICATIONS

"Roulette Systems", Scarne's Encyclopedia Of Games, John Scarne, Harper & Row Publishers, pp. 557–559, 1973.*

* cited by examiner

*Primary Examiner*—Benjamin H. Layno
(74) *Attorney, Agent, or Firm*—Smith, Gambrell & Russell, LLP; Herbert M. Hanegan; J. Rodgers Lunsford III

(57) ABSTRACT

A method and device for generating hot sheets for lottery numbers based upon previously drawn numbers and astronomical data. A player selects at least one number for input. The input number is then searched for in a database containing historical data of at least one comparison lottery including the number and date of previous draws. It is then determined when the number selected by the user was previously drawn in the comparison lottery by accessing the comparison lottery database. A second database, which is also accessible by the device, which may be a part of the first database, contains data regarding the timing of certain astronomical events, such as planet aspects, planet ingress, moon ingress, and the phases and eclipses of the moon. Time gaps between the time of the previous drawings of the number selected by the player is determined, such as by using the dates immediately before and after the dates the number previously fell. Based upon these time gaps hot numbers are determined for each of the astronomical events, such as the number corresponding to the smallest and largest time gaps for each event. These numbers are then displayed on a display and/or printed on a sheet of paper as a "hot sheet" to be used in selecting numbers for play in a lottery.

13 Claims, 9 Drawing Sheets

| Date | Drawn Numbers | Date | Drawn Numbers | Date | Drawn Numbers | Date | Drawn Numbers | Date | Drawn Numbers |
|---|---|---|---|---|---|---|---|---|---|
| 01/01/99 | 1-5-7 | 03/21/00 | 0-8-9 | 06/08/99 | 3-7-5 | 08/26/99 | 4-8-2 | 11/13/99 | 8-9-0 |
| 01/02/99 | 3-4-6 | 03/22/99 | 4-5-7 | 06/09/99 | 5-3-4 | 08/27/99 | 8-6-9 | 11/14/99 | 4-2-8 |
| 01/03/99 | 9-8-2 | 03/23/99 | 5-9-3 | 06/10/99 | 9-7-0 | 08/28/99 | 3-6-4 | 11/15/99 | 0-9-6 |
| 01/04/99 | 0-2-8 | 03/24/99 | 7-0-9 | 06/11/99 | 7-3-0 | 08/29/99 | 7-2-6 | 11/16/99 | 2-4-0 |
| 01/05/99 | 8-6-3 | 03/25/99 | 4-0-6 | 06/12/99 | 3-9-7 | 08/30/99 | 4-5-3 | 11/17/99 | 0-6-7 |
| 01/06/99 | 4-9-8 | 03/26/99 | 6-3-1 | 06/13/99 | 0-4-1 | 08/31/99 | 7-5-1 | 11/18/99 | 7-8-9 |
| 01/07/99 | 2-4-8 | 03/27/99 | 7-9-8 | 06/14/99 | 6-8-3 | 09/01/99 | 0-5-4 | 11/19/99 | 5-8-3 |
| 01/08/99 | 6-0-5 | 03/28/99 | 4-6-0 | 06/15/99 | 7-6-1 | 09/02/99 | 7-3-2 | 11/20/99 | 7-6-1 |
| 01/09/99 | 0-3-6 | 03/29/99 | 3-5-7 | 06/16/99 | 8-3-0 | 09/03/99 | 2-4-9 | 11/21/99 | 0-7-7 |
| 01/10/99 | 2-5-7 | 03/30/99 | 9-0-4 | 06/17/99 | 4-5-0 | 09/04/99 | 3-1-0 | 11/22/99 | 0-8-2 |
| 01/11/99 | 3-8-1 | 03/31/99 | 4-0-8 | 06/18/99 | 7-8-9 | 09/05/99 | 9-2-1 | 11/23/99 | 5-8-3 |
| 01/12/99 | 0-5-3 | 04/01/99 | 7-2-9 | 06/19/99 | 4-2-1 | 09/06/99 | 7-5-1 | 11/24/99 | 4-9-0 |
| 01/13/99 | 4-8-0 | 04/02/99 | 8-1-0 | 06/20/99 | 0-7-7 | 09/07/99 | 8-4-3 | 11/25/99 | 6-8-5 |
| 01/14/99 | 3-5-9 | 04/03/99 | 2-5-0 | 06/21/99 | 6-3-0 | 09/08/99 | 7-5-1 | 11/26/99 | 0-3-7 |
| 01/15/99 | 8-4-0 | 04/04/99 | 4-3-0 | 06/22/99 | 0-2-5 | 09/09/99 | 0-5-4 | 11/27/99 | 9-0-5 |
| 01/16/99 | 6-5-0 | 04/05/99 | 1-8-9 | 06/23/99 | 5-8-6 | 09/10/99 | 7-3-2 | 11/28/99 | 3-5-0 |
| 01/17/99 | 2-5-0 | 04/06/99 | 4-6-2 | 06/24/99 | 7-9-2 | 09/11/99 | 2-4-9 | 11/29/99 | 5-0-9 |
| 01/18/99 | 1-2-3 | 04/07/99 | 0-8-1 | 06/25/99 | 3-8-1 | 09/12/99 | 3-1-0 | 11/30/99 | 7-0-3 |
| 01/19/99 | 7-9-5 | 04/08/99 | 0-9-4 | 06/26/99 | 2-8-9 | 09/13/99 | 9-2-1 | 12/01/99 | 4-6-8 |
| 01/20/99 | 6-0-9 | 04/09/99 | 1-0-7 | 06/27/99 | 9-7-3 | 09/14/99 | 7-5-1 | 12/02/99 | 1-9-3 |
| 01/21/99 | 3-5-1 | 04/10/99 | 9-8-1 | 06/28/99 | 4-9-0 | 09/15/99 | 8-4-3 | 12/03/99 | 5-4-0 |
| 01/22/99 | 0-8-7 | 04/11/99 | 8-7-0 | 06/29/99 | 8-0-7 | 09/16/99 | 0-8-6 | 12/04/99 | 7-5-6 |
| 01/23/99 | 6-3-5 | 04/12/99 | 5-2-0 | 06/30/99 | 7-0-6 | 09/17/99 | 7-5-0 | 12/05/99 | 8-6-3 |
| 01/24/99 | 7-1-8 | 04/13/99 | 0-6-8 | 07/01/99 | 5-0-6 | 09/18/99 | 4-3-8 | 12/06/99 | 1-0-9 |
| 01/25/99 | 0-3-8 | 04/14/99 | 3-8-7 | 07/02/99 | 3-2-1 | 09/19/99 | 9-0-4 | 12/07/99 | 0-8-3 |
| 01/26/99 | 4-6-0 | 04/15/99 | 4-5-2 | 07/03/99 | 2-8-3 | 09/20/99 | 0-3-1 | 12/08/99 | 4-9-3 |
| 01/27/99 | 9-6-3 | 04/16/99 | 1-0-1 | 07/04/99 | 3-4-9 | 09/21/99 | 2-1-3 | 12/09/99 | 6-0-4 |
| 01/28/99 | 1-5-9 | 04/17/99 | 2-8-0 | 07/05/99 | 0-4-0 | 09/22/99 | 6-7-6 | 12/10/99 | 8-8-6 |
| 01/29/99 | 9-5-1 | 04/18/99 | 0-2-6 | 07/06/99 | 9-0-8 | 09/23/99 | 8-0-1 | 12/11/99 | 4-0-6 |
| 01/30/99 | 7-5-3 | 04/19/99 | 3-6-8 | 07/07/99 | 7-5-3 | 09/24/99 | 4-9-3 | 12/12/99 | 8-4-0 |
| 01/31/99 | 3-5-7 | 04/20/99 | 9-7-1 | 07/08/99 | 4-1-9 | 09/25/99 | 9-4-0 | 12/13/99 | 7-5-1 |
| 02/01/99 | 8-5-2 | 04/21/99 | 3-0-0 | 07/09/99 | 9-7-3 | 09/26/99 | 7-3-9 | 12/14/99 | 4-5-3 |
| 02/02/99 | 0-5-8 | 04/22/99 | 1-9-9 | 07/10/99 | 6-8-2 | 09/27/99 | 6-7-5 | 12/15/99 | 3-5-4 |
| 02/03/99 | 2-5-8 | 04/23/99 | 2-8-9 | 07/11/99 | 5-1-7 | 09/28/99 | 0-6-8 | 12/16/99 | 6-4-0 |
| 02/04/99 | 6-8-0 | 04/24/99 | 3-9-9 | 07/12/99 | 7-0-9 | 09/29/99 | 6-0-7 | 12/17/99 | 8-4-6 |
| 02/05/99 | 4-5-9 | 04/25/99 | 4-8-9 | 07/13/99 | 4-9-3 | 09/30/99 | 4-0-2 | 12/18/99 | 7-5-0 |
| 02/06/99 | 3-6-5 | 04/26/99 | 9-9-9 | 07/14/99 | 6-3-0 | 10/01/99 | 2-8-7 | 12/19/99 | 2-9-4 |
| 02/07/99 | 1-0-6 | 04/27/99 | 3-8-4 | 07/15/99 | 2-5-7 | 10/02/99 | 9-7-5 | 12/20/99 | 4-3-8 |
| 02/08/99 | 5-8-2 | 04/28/99 | 2-8-1 | 07/16/99 | 7-3-7 | 10/03/99 | 4-6-9 | 12/21/99 | 8-4-5 |
| 02/09/99 | 8-3-6 | 04/29/99 | 2-9-9 | 07/17/99 | 8-5-8 | 10/04/99 | 8-7-0 | 12/22/99 | 0-6-7 |
| 02/10/99 | 0-7-9 | 04/30/99 | 6-0-9 | 07/18/99 | 4-9-9 | 10/05/99 | 3-5-6 | 12/23/99 | 8-4-7 |
| 02/11/99 | 8-2-3 | 05/01/99 | 5-7-1 | 07/19/99 | 0-6-6 | 10/06/99 | 0-8-6 | 12/24/99 | 9-2-3 |
| 02/12/99 | 6-3-9 | 05/02/99 | 8-0-4 | 07/20/99 | 3-4-7 | 10/07/99 | 6-7-4 | 12/25/99 | 3-7-1 |
| 02/13/99 | 1-5-9 | 05/03/99 | 1-0-7 | 07/21/99 | 5-2-9 | 10/08/99 | 5-8-3 | 12/26/99 | 6-4-0 |
| 02/14/99 | 7-5-3 | 05/04/99 | 2-3-7 | 07/22/99 | 6-4-7 | 10/09/99 | 2-8-4 | 12/27/99 | 9-8-4 |
| 02/15/99 | 9-5-1 | 05/05/99 | 6-1-0 | 07/23/99 | 3-2-9 | 10/10/99 | 4-8-2 | 12/28/99 | 7-5-1 |
| 02/16/99 | 2-5-8 | 05/06/99 | 5-8-7 | 07/24/99 | 3-4-0 | 10/11/99 | 6-8-0 | 12/29/99 | 5-3-4 |
| 02/17/99 | 7-4-1 | 05/07/99 | 6-1-7 | 07/25/99 | 6-0-3 | 10/12/99 | 0-9-5 | 12/30/99 | 8-6-3 |
| 02/18/99 | 9-6-3 | 05/08/99 | 7-9-2 | 07/26/99 | 7-0-6 | 10/13/99 | 6-7-0 | 12/31/99 | 2-3-1 |
| 02/19/99 | 0-2-5 | 05/09/99 | 1-9-9 | 07/27/99 | 3-8-4 | 10/14/99 | 4-8-3 | | |
| 02/20/99 | 3-0-2 | 05/10/99 | 0-8-4 | 07/28/99 | 7-9-0 | 10/15/99 | 7-2-3 | | |
| 02/21/99 | 6-5-8 | 05/11/99 | 7-1-1 | 07/29/99 | 1-7-3 | 10/16/99 | 4-0-3 | | |
| 02/22/99 | 9-2-0 | 05/12/99 | 2-7-8 | 07/30/99 | 6-2-5 | 10/17/99 | 8-0-6 | | |
| 02/23/99 | 8-4-0 | 05/13/99 | 6-4-1 | 07/31/99 | 6-7-9 | 10/18/99 | 7-8-0 | | |
| 02/24/99 | 7-5-3 | 05/14/99 | 3-5-9 | 08/01/99 | 1-0-9 | 10/19/99 | 5-3-7 | | |
| 02/25/99 | 1-5-9 | 05/15/99 | 7-8-9 | 08/02/99 | 0-8-9 | 10/20/99 | 1-5-0 | | |
| 02/26/99 | 0-8-4 | 05/16/99 | 8-9-9 | 08/03/99 | 9-0-5 | 10/21/99 | 0-9-1 | | |
| 02/27/99 | 2-0-9 | 05/17/99 | 2-1-0 | 08/04/99 | 7-3-5 | 10/22/99 | 6-7-5 | | |
| 02/28/99 | 4-6-8 | 05/18/99 | 7-6-2 | 08/05/99 | 4-2-6 | 10/23/99 | 6-4-2 | | |
| 03/01/99 | 7-8-2 | 05/19/99 | 6-8-1 | 08/06/99 | 1-0-3 | 10/24/99 | 8-4-9 | | |
| 03/02/99 | 3-0-1 | 05/20/99 | 6-0-4 | 08/07/99 | 6-5-9 | 10/25/99 | 6-1-0 | | |
| 03/03/99 | 0-6-7 | 05/21/99 | 2-8-9 | 08/08/99 | 0-6-4 | 10/26/99 | 7-2-5 | | |
| 03/04/99 | 4-5-2 | 05/22/99 | 4-5-1 | 08/09/99 | 3-5-7 | 10/27/99 | 0-8-8 | | |
| 03/05/99 | 7-2-9 | 05/23/99 | 0-3-5 | 08/10/99 | 1-0-6 | 10/28/99 | 1-4-7 | | |
| 03/06/99 | 9-5-1 | 05/24/99 | 5-0-9 | 08/11/99 | 7-8-3 | 10/29/99 | 3-9-8 | | |
| 03/07/99 | 8-5-2 | 05/25/99 | 7-3-6 | 08/12/99 | 2-9-8 | 10/30/99 | 6-5-0 | | |
| 03/08/99 | 4-3-9 | 05/26/99 | 9-3-1 | 08/13/99 | 7-2-8 | 10/31/99 | 0-4-5 | | |
| 03/09/99 | 7-4-1 | 05/27/99 | 0-4-3 | 08/14/99 | 4-3-1 | 11/01/99 | 3-2-1 | | |
| 03/10/99 | 5-4-9 | 05/28/99 | 7-6-8 | 08/15/99 | 6-8-4 | 11/02/99 | 0-7-6 | | |
| 03/11/99 | 8-7-5 | 05/29/99 | 9-5-4 | 08/16/99 | 3-5-1 | 11/03/99 | 4-5-9 | | |
| 03/12/99 | 9-5-7 | 05/30/99 | 3-7-9 | 08/17/99 | 0-7-9 | 11/04/99 | 7-5-3 | | |
| 03/13/99 | 3-6-0 | 05/31/99 | 8-3-7 | 08/18/99 | 4-5-9 | 11/05/99 | 4-2-0 | | |
| 03/14/99 | 7-3-6 | 06/01/99 | 2-3-9 | 08/19/99 | 1-5-7 | 11/06/99 | 0-6-8 | | |
| 03/15/99 | 5-8-0 | 06/02/99 | 0-8-5 | 08/20/99 | 6-8-9 | 11/07/99 | 2-5-8 | | |
| 03/16/99 | 8-4-3 | 06/03/99 | 5-9-1 | 08/21/99 | 3-4-2 | 11/08/99 | 7-5-3 | | |
| 03/17/99 | 7-9-0 | 06/04/99 | 6-8-1 | 08/22/99 | 7-2-3 | 11/09/99 | 1-5-9 | | |
| 03/18/99 | 9-5-1 | 06/05/99 | 3-7-6 | 08/23/99 | 1-4-9 | 11/10/99 | 4-6-5 | | |
| 03/19/99 | 6-4-0 | 06/06/99 | 2-8-4 | 08/24/99 | 8-7-3 | 11/11/99 | 2-7-1 | | |
| 03/20/99 | 8-4-7 | 06/07/99 | 6-5-3 | 08/25/99 | 9-2-6 | 11/12/99 | 3-8-4 | | |

FIG. 3
(1 of 2)

| Date | Drawn Numbers | Date | Drawn Numbers | Date | Drawn Numbers | Date | Drawn Numbers | Date | Drawn Numbers |
|---|---|---|---|---|---|---|---|---|---|
| 01/01/00 | 0-6-5 | 03/22/00 | 3-5-6 | 06/11/00 | 3-1-8 | 08/31/00 | 5-8-2 | 11/20/00 | 9-4-3 |
| 01/02/00 | 3-5-4 | 03/23/00 | 6-8-1 | 06/12/00 | 6-7-1 | 09/01/00 | 9-5-8 | 11/21/00 | 7-2-6 |
| 01/03/00 | 5-2-0 | 03/24/00 | 4-7-9 | 06/13/00 | 9-8-3 | 09/02/00 | 7-3-0 | 11/22/00 | 2-6-4 |
| 01/04/00 | 4-8-3 | 03/25/00 | 3-0-2 | 06/14/00 | 7-5-1 | 09/03/00 | 5-9-1 | 11/23/00 | 7-2-6 |
| 01/05/00 | 0-1-5 | 03/26/00 | 2-5-1 | 06/15/00 | 0-2-2 | 09/04/00 | 2-3-0 | 11/24/00 | 4-1-6 |
| 01/06/00 | 5-8-9 | 03/27/00 | 7-0-3 | 06/16/00 | 4-0-3 | 09/05/00 | 7-9-0 | 11/25/00 | 7-5-7 |
| 01/07/00 | 6-0-4 | 03/28/00 | 6-5-1 | 06/17/00 | 9-8-1 | 09/06/00 | 6-5-2 | 11/26/00 | 3-9-9 |
| 01/08/00 | 0-4-6 | 03/29/00 | 3-2-9 | 06/18/00 | 4-8-3 | 09/07/00 | 3-6-7 | 11/27/00 | 0-4-2 |
| 01/09/00 | 4-0-6 | 03/30/00 | 5-6-7 | 06/19/00 | 2-1-0 | 09/08/00 | 4-5-0 | 11/28/00 | 5-2-3 |
| 01/10/00 | 0-6-4 | 03/31/00 | 4-3-7 | 06/20/00 | 6-8-4 | 09/09/99 | 1-2-3 | 11/29/00 | 7-8-1 |
| 01/11/00 | 6-4-0 | 04/01/00 | 3-0-9 | 06/21/00 | 2-1-0 | 09/10/00 | 8-5-0 | 11/30/00 | 4-1-5 |
| 01/12/00 | 5-8-2 | 04/02/00 | 7-5-3 | 06/22/00 | 3-1-2 | 09/11/00 | 5-0-1 | 12/01/00 | 2-8-7 |
| 01/13/00 | 3-8-9 | 04/03/00 | 1-0-8 | 06/23/00 | 7-8-2 | 09/12/00 | 0-9-0 | 12/02/00 | 3-8-7 |
| 01/14/00 | 2-5-4 | 04/04/00 | 0-7-3 | 06/24/00 | 4-0-6 | 09/13/00 | 8-7-5 | 12/03/00 | 4-7-9 |
| 01/15/00 | 1-0-1 | 04/05/00 | 6-5-2 | 06/25/00 | 0-9-9 | 09/14/00 | 3-6-4 | 12/04/00 | 2-0-9 |
| 01/16/00 | 7-8-0 | 04/06/00 | 0-9-0 | 06/26/00 | 1-0-1 | 09/15/00 | 9-7-2 | 12/05/00 | 6-7-1 |
| 01/17/00 | 5-4-9 | 04/07/00 | 4-6-8 | 06/27/00 | 8-8-5 | 09/16/00 | 1-0-2 | 12/06/00 | 2-1-7 |
| 01/18/00 | 6-3-5 | 04/08/00 | 3-1-2 | 06/28/00 | 4-6-2 | 09/17/00 | 4-8-3 | 12/07/00 | 0-7-7 |
| 01/19/00 | 0-7-6 | 04/09/00 | 6-5-9 | 06/29/00 | 7-2-0 | 09/18/00 | 2-0-7 | 12/08/00 | 7-0-1 |
| 01/20/00 | 4-0-1 | 04/10/00 | 5-2-7 | 06/30/00 | 6-1-7 | 09/19/00 | 4-9-6 | 12/09/00 | 9-1-1 |
| 01/21/00 | 2-8-3 | 04/11/00 | 6-7-1 | 07/01/00 | 0-2-8 | 09/20/00 | 1-3-8 | 12/10/00 | 4-8-7 |
| 01/22/00 | 8-5-6 | 04/12/00 | 0-0-7 | 07/02/00 | 4-6-8 | 09/21/00 | 7-2-6 | 12/11/00 | 7-1-1 |
| 01/23/00 | 0-2-1 | 04/13/00 | 8-7-5 | 07/03/00 | 4-5-0 | 09/22/00 | 9-5-0 | 12/12/00 | 6-4-2 |
| 01/24/00 | 9-4-3 | 04/14/00 | 6-5-2 | 07/04/00 | 9-0-2 | 09/23/00 | 2-8-9 | 12/13/00 | 3-2-5 |
| 01/25/00 | 4-5-0 | 04/15/00 | 3-7-1 | 07/05/00 | 0-5-5 | 09/24/00 | 6-9-0 | 12/14/00 | 4-5-9 |
| 01/26/00 | 2-8-6 | 04/16/00 | 1-0-1 | 07/06/00 | 3-8-6 | 09/25/00 | 3-4-7 | 12/15/00 | 0-6-8 |
| 01/27/00 | 6-8-2 | 04/17/00 | 2-8-0 | 07/07/00 | 7-2-1 | 09/26/00 | 1-8-7 | 12/16/00 | 6-5-9 |
| 01/28/00 | 1-7-3 | 04/18/00 | 5-0-1 | 07/08/00 | 9-1-1 | 09/27/00 | 1-1-7 | 12/17/00 | 8-5-7 |
| 01/29/00 | 9-0-8 | 04/19/00 | 6-5-8 | 07/09/00 | 1-2-5 | 09/28/00 | 8-1-7 | 12/18/00 | 3-2-1 |
| 01/30/00 | 0-4-2 | 04/20/00 | 9-2-0 | 07/10/00 | 5-8-6 | 09/29/00 | 3-0-5 | 12/19/00 | 8-1-5 |
| 01/31/00 | 3-8-4 | 04/21/00 | 7-2-3 | 07/11/00 | 3-8-7 | 09/30/00 | 2-1-3 | 12/20/00 | 3-5-5 |
| 02/01/00 | 7-2-1 | 04/22/00 | 6-9-8 | 07/12/00 | 5-7-6 | 10/01/00 | 3-1-2 | 12/21/00 | 9-2-6 |
| 02/02/00 | 5-9-0 | 04/23/00 | 4-5-3 | 07/13/00 | 3-2-0 | 10/02/00 | 7-2-4 | 12/22/00 | 0-3-3 |
| 02/03/00 | 4-8-3 | 04/24/00 | 2-0-1 | 07/14/00 | 4-8-6 | 10/03/00 | 1-0-3 | 12/23/00 | 1-0-4 |
| 02/04/00 | 2-5-8 | 04/25/00 | 0-8-4 | 07/15/00 | 5-2-3 | 10/04/00 | 2-5-0 | 12/24/00 | 9-8-7 |
| 02/05/00 | 4-0-3 | 04/26/00 | 7-8-2 | 07/16/00 | 4-3-8 | 10/05/00 | 4-1-3 | 12/25/00 | 6-8-1 |
| 02/06/00 | 7-2-6 | 04/27/00 | 6-4-3 | 07/17/00 | 3-5-6 | 10/06/00 | 9-8-0 | 12/26/00 | 3-2-8 |
| 02/07/00 | 2-0-0 | 04/28/00 | 2-9-8 | 07/18/00 | 8-9-0 | 10/07/00 | 4-7-3 | 12/27/00 | 8-5-4 |
| 02/08/00 | 6-8-4 | 04/29/00 | 4-9-3 | 07/19/00 | 9-9-9 | 10/08/00 | 2-0-0 | 12/28/00 | 6-8-7 |
| 02/09/00 | 1-9-9 | 04/30/00 | 2-5-7 | 07/20/00 | 4-1-3 | 10/09/00 | 4-2-8 | 12/29/00 | 3-0-2 |
| 02/10/00 | 2-8-1 | 05/01/00 | 6-5-2 | 07/21/00 | 7-5-3 | 10/10/00 | 5-2-0 | 12/30/00 | 7-5-1 |
| 02/11/00 | 9-8-4 | 05/02/00 | 4-9-0 | 07/22/00 | 2-8-4 | 10/11/00 | 4-8-9 | 12/31/00 | 2-3-8 |
| 02/12/00 | 6-5-7 | 05/03/00 | 3-5-8 | 07/23/00 | 9-2-4 | 10/12/00 | 6-8-9 | | |
| 02/13/00 | 9-1-0 | 05/04/00 | 7-5-2 | 07/24/00 | 6-3-7 | 10/13/00 | 4-0-7 | | |
| 02/14/00 | 5-6-3 | 05/05/00 | 3-2-7 | 07/25/00 | 4-1-1 | 10/14/00 | 8-2-4 | | |
| 02/15/00 | 7-5-1 | 05/06/00 | 2-0-3 | 07/26/00 | 2-0-7 | 10/15/00 | 7-2-0 | | |
| 02/16/00 | 9-0-3 | 05/07/00 | 0-9-7 | 07/27/00 | 6-5-1 | 10/16/00 | 4-0-6 | | |
| 02/17/00 | 4-2-6 | 05/08/00 | 4-5-3 | 07/28/00 | 8-1-1 | 10/17/00 | 9-5-0 | | |
| 02/18/00 | 0-8-6 | 05/09/00 | 8-5-6 | 07/29/00 | 9-1-7 | 10/18/00 | 7-5-0 | | |
| 02/19/00 | 7-5-2 | 05/10/00 | 4-8-2 | 07/30/00 | 9-5-2 | 10/19/00 | 3-8-1 | | |
| 02/20/00 | 6-8-0 | 05/11/00 | 2-6-5 | 07/31/00 | 7-5-0 | 10/20/00 | 0-8-7 | | |
| 02/21/00 | 4-5-0 | 05/12/00 | 7-9-8 | 08/01/00 | 1-7-5 | 10/21/00 | 6-4-2 | | |
| 02/22/00 | 9-6-3 | 05/13/00 | 2-8-9 | 08/02/00 | 1-3-3 | 10/22/00 | 1-1-1 | | |
| 02/23/00 | 7-2-3 | 05/14/00 | 6-5-2 | 08/03/00 | 2-2-7 | 10/23/00 | 7-6-1 | | |
| 02/24/00 | 8-6-0 | 05/15/00 | 0-8-6 | 08/04/00 | 0-5-6 | 10/24/00 | 3-7-5 | | |
| 02/25/00 | 3-5-8 | 05/16/00 | 3-5-8 | 08/05/00 | 7-5-2 | 10/25/00 | 6-9-0 | | |
| 02/26/00 | 1-8-6 | 05/17/00 | 8-7-2 | 08/06/00 | 7-3-5 | 10/26/00 | 4-5-7 | | |
| 02/27/00 | 5-3-2 | 05/18/00 | 1-7-5 | 08/07/00 | 1-6-3 | 10/27/00 | 5-8-4 | | |
| 02/28/00 | 2-3-9 | 05/19/00 | 3-5-2 | 08/08/00 | 2-9-4 | 10/28/00 | 7-5-7 | | |
| 02/29/00 | 3-3-3 | 05/20/00 | 5-4-0 | 08/09/00 | 4-2-0 | 10/29/00 | 0-6-6 | | |
| 03/01/00 | 8-4-2 | 05/21/00 | 7-2-1 | 08/10/00 | 8-5-2 | 10/30/00 | 4-0-2 | | |
| 03/02/00 | 3-2-1 | 05/22/00 | 4-8-3 | 08/11/00 | 1-6-7 | 10/31/00 | 4-2-6 | | |
| 03/03/00 | 9-0-7 | 05/23/00 | 2-6-4 | 08/12/00 | 4-5-3 | 11/01/00 | 7-5-1 | | |
| 03/04/00 | 3-2-7 | 05/24/00 | 3-5-8 | 08/13/00 | 2-5-0 | 11/02/00 | 8-9-4 | | |
| 03/05/00 | 9-8-4 | 05/25/00 | 9-5-4 | 08/14/00 | 3-0-7 | 11/03/00 | 7-2-3 | | |
| 03/06/00 | 3-5-9 | 05/26/00 | 6-7-0 | 08/15/00 | 0-5-5 | 11/04/00 | 3-5-7 | | |
| 03/07/00 | 0-1-5 | 05/27/00 | 3-8-4 | 08/16/00 | 7-5-5 | 11/05/00 | 2-1-1 | | |
| 03/08/00 | 7-5-0 | 05/28/00 | 2-3-1 | 08/17/00 | 4-5-5 | 11/06/00 | 0-8-9 | | |
| 03/09/00 | 6-5-1 | 05/29/00 | 3-1-0 | 08/18/00 | 1-6-9 | 11/07/00 | 6-5-1 | | |
| 03/10/00 | 7-4-1 | 05/30/00 | 2-5-6 | 08/19/00 | 8-3-1 | 11/08/00 | 7-5-9 | | |
| 03/11/00 | 4-2-1 | 05/31/00 | 7-2-3 | 08/20/00 | 2-1-3 | 11/09/00 | 4-5-6 | | |
| 03/12/00 | 8-1-9 | 06/01/00 | 0-8-6 | 08/21/00 | 6-8-4 | 11/10/00 | 0-4-1 | | |
| 03/13/00 | 6-2-4 | 06/02/00 | 1-0-1 | 08/22/00 | 2-6-8 | 11/11/00 | 9-8-7 | | |
| 03/14/00 | 1-1-0 | 06/03/00 | 6-8-2 | 08/23/00 | 3-7-2 | 11/12/00 | 6-3-2 | | |
| 03/15/00 | 4-5-8 | 06/04/00 | 0-4-4 | 08/24/00 | 0-3-4 | 11/13/00 | 7-8-0 | | |
| 03/16/00 | 5-6-9 | 06/05/00 | 3-8-2 | 08/25/00 | 6-5-3 | 11/14/00 | 4-8-0 | | |
| 03/17/00 | 0-0-9 | 06/06/00 | 2-6-7 | 08/26/00 | 4-8-9 | 11/15/00 | 2-8-5 | | |
| 03/18/00 | 5-8-0 | 06/07/00 | 4-5-9 | 08/27/00 | 2-3-4 | 11/16/00 | 3-2-6 | | |
| 03/19/00 | 7-6-0 | 06/08/00 | 7-4-1 | 08/28/00 | 5-9-7 | 11/17/00 | 4-0-4 | | |
| 03/20/00 | 4-2-3 | 06/09/00 | 6-9-8 | 08/29/00 | 4-1-1 | 11/18/00 | 9-8-3 | | |
| 03/21/00 | 3-8-1 | 06/10/00 | 3-2-1 | 08/30/00 | 2-5-8 | 11/19/00 | 6-9-7 | | |

FIG. 3
(Continued 2 of 2)

January, Year X

981 Planet Ingress

| Planet | Sign | Date | Time |
|---|---|---|---|
| Mercury | Aquarius | 8 | 4:47a.m. |
| Sun | Aquarius | 20 | 5:45p.m. |
| Venus | Capricorn | 26 | 10:36p.m. |
| Pluto | Libra | 30 | 7:02a.m. |

983 Planet Aspect

| Planet | Position | Date | Time |
|---|---|---|---|
| Mars | 120°trine | 2 | 12:34a.m |
| Mercury | 60° sextile | 4 | 12:32a.m. |
| Pluto | 0°conjunction | 7 | 12:28a.m. |
| Sun | 0° conjunction | 8 | 11:38a.m. |
| Pluto | 60° sextile | 11 | 5:53 p.m. |
| Pluto | 90° square | 13 | 11:42 p.m. |
| Pluto | 120°trine | 16 | 3:40 a.m. |
| Sun | 120° trine | 18 | 2:06 a.m. |
| Pluto | 180°opposition | 20 | 7:47 a.m. |
| Uranus | 120°trine | 21 | 10:57 a.m. |
| Pluto | 120° trine | 24 | 2:44 p.m. |
| Mars | 90°square | 26 | 11:33 a.m. |
| Mars | 120°trine | 28 | 9:49 p.m. |
| Mercury | 90° square | 31 | 8:36 a.m. |

985 Moon Ingress

| Sign | Date | Time |
|---|---|---|
| Scorpio | 2 | 1:33a.m. |
| Sagittarius | 4 | 2:14p.m. |
| Capricorn | 7 | 1:44a.m. |
| Aquarius | 9 | 11:14a.m. |
| Pisces | 11 | 6:45p.m. |
| Aries | 14 | 12:24a.m. |
| Taurus | 16 | 4:14a.m. |
| Gemini | 18 | 6:31a.m. |
| Cancer | 20 | 8:06a.m. |
| Leo | 22 | 10:21a.m. |
| Virgo | 24 | 2:49p.m. |
| Libra | 26 | 10:36p.m. |
| Scorpio | 29 | 9:36a.m. |
| Sagittarius | 31 | 10:09p.m. |

987 Moon Phases &Eclipses

| Event | Date | Time |
|---|---|---|
| New Moon | 8 | 11:38a.m. |
| First Qtr. Moon | 15 | 7:47p.m. |
| Full Moon | 22 | 1:36p.m. |
| Third Qtr. Moon | 30 | 5:04a.m. |

February, Year X

Planet Ingress

| Planet | Sign | Date | Time |
|---|---|---|---|
| Venus | Aquarius | 17 | 4:23p.m. |
| Sun | Pisces | 19 | 6:51a.m. |
| Mars | Capricorn | 24 | 8:07 a.m. |
| Saturn | Virgo | 26 | 3:45 a.m. |

Planet Aspect

| Planet | Position | Date | Time |
|---|---|---|---|
| Mars | 180° opposition | 2 | 10:22p.m. |
| Uranus | 60° sextile | 4 | 5:21p.m. |
| Mars | 120° trine | 7 | 3:51p.m. |
| Mars | 90° square | 9 | 9:06p.m. |
| Mars | 60° sextile | 12 | 1:01a.m. |
| Venus | 120° trine | 14 | 5:06a.m. |
| Sun | 120° trine | 16 | 10:18a.m. |
| Uranus | 120° trine | 17 | 9:14p.m. |
| Mars | 60° sextile | 20 | 5:54p.m. |
| Mars | 90° square | 23 | 2:16a.m. |
| Mars | 120° trine | 25 | 1:36p.m. |
| Neptune | 90° square | 27 | 2:55p.m. |

Moon Ingress

| Sign | Date | Time |
|---|---|---|
| Capricorn | 3 | 9:53a.m. |
| Aquarius | 5 | 7:11p.m. |
| Pisces | 8 | 1:47a.m. |
| Aries | 10 | 6:18a.m. |
| Taurus | 12 | 9:35a.m. |
| Gemini | 14 | 12:20p.m. |
| Cancer | 16 | 3:13p.m. |
| Leo | 18 | 6:52p.m. |
| Virgo | 21 | 12:07a.m. |
| Libra | 23 | 7:46a.m. |
| Scorpio | 25 | 6:07p.m. |
| Sagittarius | 28 | 6:23a.m. |

Moon Phases & Eclipses

| Event | Date | Time |
|---|---|---|
| New Moon | 7 | 3:46a.m. |
| First Qtr. Moon | 14 | 3:35a.m. |
| Full Moon | 21 | 3:32a.m. |
| Third Qtr. Moon | 27 | 2:19a.m. |

FIG. 4 (1 of 3)

September, Year X

| Planet Ingress | | | Planet Aspect | | | Moon Ingress | | Moon Phases &Eclipses | |
|---|---|---|---|---|---|---|---|---|---|
| Planet | Sign | Date Time | Planet | Position | Date Time | Sign | Date Time | Event | Date Time |
| Sun | Libra | 22 3:46p.m. | Pluto | 90°square | 1 9:03a.m. | Libra | 1 11:46a.m. | First Qtr. Moon | 7 2:05p.m. |
| Mercury | Scorpio | 24 3:00a.m. | Pluto | 60° sextile | 3 5:10p.m. | Scorpio | 3 8:03p.m. | Full Moon | 15 9:14a.m. |
| | | | Neptune | 90°square | 5 3:46p.m. | Sagittarius | 6 7:12a.m. | Third Qtr. Moon | 22 5:05a.m. |
| | | | Pluto | 0° conjunction | 8 4:44p.m. | Capricorn | 8 7:46p.m. | New Moon | 29 8:13a.m. |
| | | | Uranus | 60° sextile | 10 1:16p.m. | Aquarius | 11 7:21a.m. | | |
| | | | Pluto | 60° sextile | 13 1:20p.m. | Pisces | 13 4:06p.m. | | |
| | | | Pluto | 90°square | 15 7:04p.m. | Aries | 15 9:40p.m. | | |
| | | | Pluto | 120° trine | 17 9:27p.m. | Taurus | 18 12:58a.m. | | |
| | | | Sun | 120°trine | 19 9:52p.m. | Gemini | 20 3:18a.m. | | |
| | | | Sun | 90°square | 22 5:05a.m. | Cancer | 22 5:50a.m. | | |
| | | | Mars | 90°square | 23 8:18p.m. | Leo | 24 9:15a.m. | | |
| | | | Pluto | 120°trine | 26 11:21 a.m. | Virgo | 26 1:53p.m. | | |
| | | | Pluto | 90° square | 28 5:32p.m. | Libra | 28 8:07p.m. | | |

October, Year X

| Planet Ingress | | | Planet Aspect | | | Moon Ingress | | Moon Phases & Eclipses | |
|---|---|---|---|---|---|---|---|---|---|
| Planet | Sign | Date Time | Planet | Position | Date Time | Sign | Date Time | Event | Date Time |
| Mars | Scorpio | 4 4:35a.m. | Pluto | 60° sextile | 1 1:49a.m. | Scorpio | 1 4:27a.m. | First Qtr. Moon | 7 9:05a.m. |
| Venus | Sagittarius | 18 6:32p.m. | Neptune | 90° square | 2 9:47p.m. | Sagitattius | 3 3:15p.m. | Full Moon | 17 8:03p.m. |
| Sun | Scorpio | 23 1:10a.m. | Pluto | 0° conjunction | 6 1:09a.m. | Carpricorn | 6 3:50a.m. | Third Qtr. Moon | 21 11:56a.m. |
| | | | Uranus | 60° sextile | 7 7:38p.m. | Aquarius | 8 4:04p.m. | New Moon | 28 11:15p.m. |
| | | | Pluto | 60° sextile | 10 11:14p.m. | Pisces | 11 1:32a.m. | | |
| | | | Pluto | 90° square | 13 5:03a.m. | Aries | 13 7:08a.m. | | |
| | | | Pluto | 120° trine | 15 7:37a.m. | Taurus | 15 9:32a.m. | | |
| | | | Venus | 180° opposition | 17 7:34a.m. | Gemini | 17 10:26a.m. | | |
| | | | Pluto | 180° opposition | 19 9:53a.m. | Cancer | 19 11:41a.m. | | |
| | | | Sun | 90° square | 21 11:56a.m. | Leo | 21 2:36p.m. | | |
| | | | Pluto | 120° trine | 23 5:54p.m. | Virgo | 23 7:41p.m. | | |
| | | | Pluto | 90° square | 26 1:04a.m. | Libra | 26 2:49a.m. | | |
| | | | Pluto | 60° sextile | 28 10:06a.m. | Scorpio | 28 11:48a.m. | | |
| | | | Neptune | 90° square | 30 5:46a.m. | Sagittarius | 30 11:42p.m. | | |

FIG. 4 (Continued 2 of 3)

November, Year Y

| Planet Ingress | | | Planet Aspect | | | | Moon Ingress | | | Moon Phases & Eclipses | | |
|---|---|---|---|---|---|---|---|---|---|---|---|---|
| Planet | Sign | Date Time | Planet | Position | Date | Time | Sign | Date | Time | Event | Date | Time |
| Venus | Sagittarius | 1 10:05p.m. | Venus | 180° opposition | 1 | 1:40p.m. | Gemini | 1 | 2:25p.m. | Full Moon | 2 | 7:32a.m. |
| Mercury | Capricorn | 5 5:25p.m. | Mercury | 180° opposition | 3 | 10:29a.m. | Cancer | 3 | 4:02p.m. | Third Qtr. Moon | 9 | 12:14a.m. |
| Sun | Capricorn | 21 5:48p.m. | Uranus | 120° trine | 5 | 5:10a.m. | Leo | 5 | 5:08p.m. | New Moon | 15 | 12:03p.m. |
| Venus | Capricorn | 25 6:18p.m. | Neptune | 180° opposition | 7 | 8:59a.m. | Virgo | 7 | 8:07p.m. | First Qtr.Moon | 24 | 5:37p.m. |
| | | | Uranus | 180° opposition | 9 | 10:06a.m. | Libra | 9 | 10:48p.m. | Full Moon | 30 | 7:14p.m. |
| | | | Neptune | 120° trine | 11 | 5:46p.m. | Scorpio | 12 | 4:33a.m. | | | |
| | | | Neptune | 90°square | 14 | 1:19a.m. | Sagittarius | 14 | 12:26p.m. | | | |
| | | | Sun | 0° conjunction | 16 | 12:03p.m. | Capricorn | 16 | 10:33p.m. | | | |
| | | | Uranus | 60° sextile | 18 | 8:09p.m. | Aquarius | 19 | 10:40a.m. | | | |
| | | | Venus | 60° sextile | 21 | 12:55p.m. | Pisces | 21 | 11:43p.m. | | | |
| | | | Venus | 90° square | 24 | 8:10a.m. | Aries | 24 | 11:41a.m. | | | |
| | | | Jupiter | 60° sextile | 26 | 11:45a.m. | Taurus | 26 | 8:27p.m. | | | |
| | | | Jupiter | 90° square | 28 | 5:55p.m. | Gemini | 29 | 1:14a.m. | | | |
| | | | Jupiter | 120° trine | 30 | 8:3a.m. | Cancer | 30 | 6:46p.m. | | | |

December, Year Y

| Planet Ingress | | | Planet Aspect | | | | Moon Ingress | | | Moon Phases &Eclipses | | |
|---|---|---|---|---|---|---|---|---|---|---|---|---|
| Planet | Sign | Date Time | Planet | Position | Date | Time | Sign | Date | Time | Event | Date | Time |
| Mars | Virgo | 1 2:06 p.m. | Neptune | 60°sextile | 1 | 12:02a.m. | Taurus | 1 | 6:00p.m. | Full Moon | 1 | 7:15p.m. |
| Venus | Scorpio | 8 12:24a.m. | Neptune | 90° square | 3 | 6:05p.m. | Gemini | 4 | 4:54a.m. | Third Qtr. Moon | 7 | 3:57p.m. |
| Mercury | Sagittarius | 18 12:29a.m. | Mercury | 120°trine | 6 | 3:48a.m. | Cancer | 6 | 7:44a.m. | New Moon | 16 | 7:15p.m. |
| Sun | Sagittarius | 22 4:24a.m. | Uranus | 120° trine | 7 | 10:27p.m. | Leo | 8 | 10:24a.m. | First Qtr. Moon | 24 | 9:40p.m. |
| | | | Neptune | 180°opposition | 10 | 2:44a.m. | Virgo | 10 | 1:31p.m. | | | |
| | | | Mercury | 60°sextile | 12 | 7:14a.m. | Libra | 12 | 5:23p.m. | | | |
| | | | Neptune | 120°trine | 13 | 9:00a.m. | Scorpio | 14 | 12:01a.m. | | | |
| | | | Sun | 0°conjunction | 16 | 7:15p.m. | Sagittatius | 17 | 5:23a.m. | | | |
| | | | Neptune | 60°sextile | 19 | 2:47a.m. | Capricorn | 19 | 3:02p.m. | | | |
| | | | Sun | 60°sextile | 22 | 3:05a.m. | Aquarius | 22 | 3:12a.m. | | | |
| | | | Neptune | 0°conjunction | 24 | 3:37a.m. | Pisces | 24 | 4:09p.m. | | | |
| | | | Mercury | 120°trine | 26 | 2:18p.m. | Aries | 27 | 3:12a.m. | | | |
| | | | Neptune | 60°sextile | 28 | 11:34p.m. | Taurus | 29 | 10:35a.m. | | | |

FIG. 4 (Continued 3 of 3)

Please Input Lottery Numbers For Hot Sheet

$I_1$ _____

$I_2$ _____

$I_3$ _____

⋮

$I_n$ _____

FIG. 5

990

*Congratulations!!!!*

Your Hot Numbers Are:

Hot Number 1
Hot Number 2
Hot Number 3
⋮
Hot Number n

FIG. 6

METHOD AND APPARATUS FOR GENERATING NUMBERS TO PLAY IN A LOTTERY BASED ON ASTRONOMICAL EVENTS

FIELD OF THE INVENTION

The present invention relates to a method and apparatus for generating numbers based upon prior events, where such numbers will be used for betting in lottery games. More particularly, the present invention relates to a method for selecting lottery numbers based upon the relationship between recently drawn numbers in a current lottery and previously drawn lottery numbers in a comparison lottery and astronomical data such as the phases of the moon and the relative position of the planets.

BACKGROUND OF THE INVENTION

Lottery games are well known. In a typical lottery game a player pays money for the right to select a number ("selected number") for a drawing to be held in the future. If the player's selected number matches the number drawn in the lottery (the "drawn number") the player wins a prize.

The chances of picking the drawn number in a lottery game is generally discussed in terms of "odds" or probabilities. For example, according to probability theory, each possible number in the pool of potential numbers in a lottery has the same probability of being drawn as any other number, i.e., the drawing of a number is viewed as a random event. Thus, according to probability theory, the odds of selecting a winning lottery number depends upon (1) how many different possible numbers could be drawn, i.e., how large the "pool" from which the number to be drawn is; (2) how many numbers will be drawn from the pool, i.e., will only a single number be drawn or will there be multiple draws; (3) how many numbers the player elects to play; and (4) whether the player must select the numbers in the specific order they are drawn or whether any combination of the digits of the drawn number wins. For example, if the number to be drawn must have three digits, i.e. the possible drawn numbers are 000 through 999, only one number will be drawn, the player selects a single number to play, and the player must select the correct sequence of numbers in order to win, then the probability that the selected number is the same as the drawn number is 1/1000 or 0.001.

Despite the seemingly small odds of winning, lottery games are very popular. Many states, have daily drawings, including "Cash 3" or "Cash 4" games in which the player selects 3 digit and 4 digit numbers, respectively. The methods of drawing numbers may vary but often involve the drawing of a series of balls numbered 0 through 9 from containers. For example, in a Cash 3 drawing, 3 containers, each containing balls numbered 0 through 9, are rotated so as to jumble the balls within. The drawer then draws a single numbered ball from each container, with the number on each ball corresponding to one digit of the drawn number. Of course, various rules may apply to lotteries, thus varying the number of digits in the drawn number, whether a player can win by having any combination of the digits of the drawn number, and how many numbers the player must match. The larger the number of digits in the drawn number, the smaller the odds of correctly selecting the drawn number and typically the larger the prize.

People often have difficulty deciding which numbers to play in a lottery. Devices for generating numbers for lottery games are known in the art. These, prior art devices however, are generally random number generating devices.

These devices may generate completely random numbers or generate random numbers from a subset of preferred numbers supplied by the user. For example, U.S. Pat. No. 4,692,863 to Moosz discloses a random number generating device which allows a user to enter a series of "preferred numbers" from which a random number will be generated. Such devices provide for the quick selection of numbers, which is especially helpful where a player wishes to make many selections. The operators of lottery ticket outlets often have such devices, often referred to as "quick picks," so that players may quickly select multiple numbers for play. However, these methods and apparatuses do not allow the user control of determining a number by naturally occurring events, such as the position of the planets.

U.S. Pat. No. 5,110,129 to Alvarez discloses a number selecting device for darkening a predetermined amount of numbered boxes on a lottery computer game card in accordance with a picked selection of numbers selected from a group of lucky numbers stored in a computer within the device wherein the lucky numbers are associated with a particular subject of interest to the user. However, that patent does not disclose using the position of the planets and previously drawn lottery numbers as the current invention. Alvarez discloses using information cards to aid the user in choosing "lucky numbers" for a quick pick.

Of course, the key to winning a lottery game is selecting the correct number. Many people believe that numbers are not merely drawn at random, as discussed above, but are affected by certain events or relationships. For example, many people select a numerical representation of their name when playing the lottery, or will play a combination of their birthday or some other event as their "lucky" number. Oftentimes "hot sheets" of lucky numbers are sold to customers for use in playing a lottery.

Numerology is the study of the occult significance of numbers and letters. Some believe that numbers are interrelated and not truly random. Or in other words, that numbers flow in certain patterns. Thus, under numerology the drawn numbers of a lottery are interconnected. Under this belief, the drawn numbers previously drawn in other lotteries would also be related, and show particular patterns of the interrelationship of the numbers. The identification of such patterns would aid in the selection of new numbers to be played.

Furthermore, it is well known that the positions of the planets affect events on earth. For instance, the tides, eclipses, the phases of the moon and the seasons, are all affected by the relationship between the planets. Thus, many believe that such interplanetary relationships also affect or determine other events on earth such as changes in the crime rate and births. Astrology concerns this supposed influence of the stars and planets on human affairs by their positions and aspects. An aspect is the position of planets and stars with respect to one another which is held by astrologers to influence human behavior. For instance, in astrology there are twelve signs of the zodiac, which are based upon the position of the sun, moon and planets. Astrologers believe that a person's life is affected by the relationship between the position of the planets on the day a person is born with the current position of the planets.

If event A on earth is determined or affected by the position of the planets at the time of occurrence of event A then event B, which may not be closely related in time may nevertheless be related to Event A in an astronomical sense, that is, it may be related based upon a similar position of the planets as that at the time of event B. For instance, if events on earth are affected by a full moon on a particular date, then, even though an event may occur years later, i.e. not close in time, the event may occur under similar cosmic circumstances, i.e. a full moon. Thus, because the relationships between the planets can recur over time, two events, which may be distant in a temporal sense, may nevertheless be closely related in an astronomical sense.

If in a numerological sense numbers are related, then a relationship would exist between drawn numbers in a lottery. Thus, according to the above, the number drawn in a lottery is affected by the interrelationship of numbers as well as the position of the planets. Thus, the invention does not entail a random number generator as disclosed in the prior art but a method of generating lottery numbers based upon previous events.

The generation of numbers based upon previously drawn numbers and astronomical events is time consuming and difficult. For instance, one must review much historical data as to the previously drawn numbers as well as determine the time of particular astronomical events. The current invention provides a device for quickly determining such numbers and generating numbers to play in a lottery that is easy and efficient.

Thus, an object of the present invention is to provide a method in which prior events are used to generate numbers for playing in a lottery. It is another object of the invention to generate numbers for playing a lottery based upon previously drawn numbers and the position of the planets. It is another object of the invention to provide a lottery number generating device for generating numbers based upon previously drawn numbers and astronomical events. It is another object of the present invention to provide a device for providing a hot sheet for us in playing a lottery.

BRIEF SUMMARY OF THE INVENTION

The current invention provides a device and method for generating numbers to play in a lottery game based upon previously lottery numbers and astronomical events. The current invention uses historical data from a comparison lottery in conjunction with astronomical data to generate a "hot sheet" of numbers to play in a lottery. Data of a comparison lottery and astronomical events are recorded. A player inputs a number or number into a computer which can access the above-mentioned historical data. The days on which these numbers have been previously drawn in the comparison lottery are then determined. The time gap between the days immediately before and after the days on which the input numbers were previously drawn and the time of certain astronomical events is then determined. The numbers corresponding to the days of the largest and smallest time gaps for each event is then determined and generated on a display or printed. The player then plays these numbers in the lottery.

BRIEF DESCRIPTION OF THE DRAWINGS

FIG. 3 is a sample list of previously drawn lottery numbers.

FIG. 4 is a sample chart showing related astronomical data.

FIG. 5 shows an input display for inputting a number.

FIG. 6 shows an output display screen displaying a hot sheet of generated numbers.

DETAILED DESCRIPTION OF THE PREFERRED EMBODIMENTS

Figure 1:
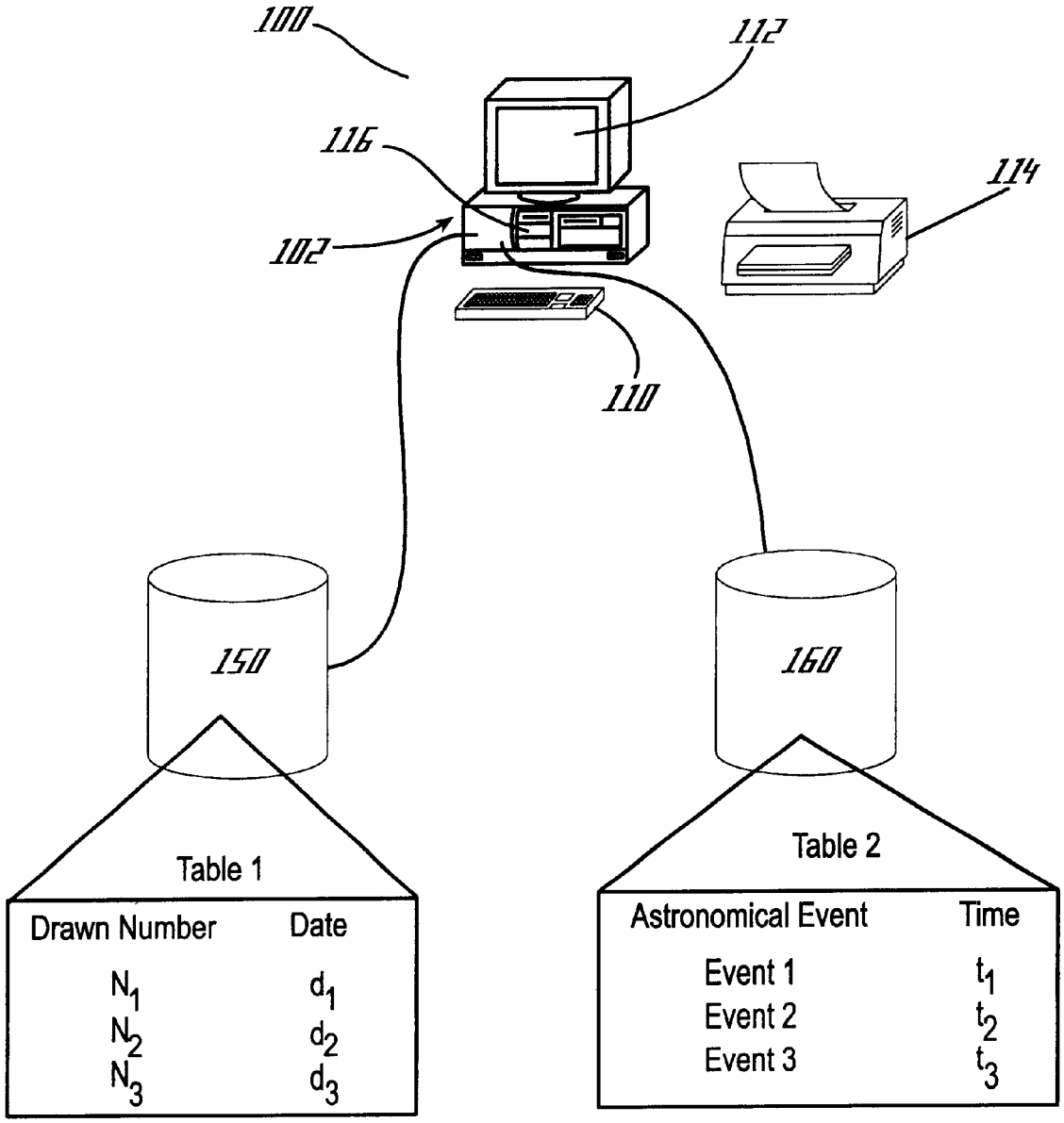
FIG. 1 is a Block Diagram showing a preferred embodiment of the invention.

The current invention uses the interrelationship between previously drawn numbers and astronomical data. Based upon this information, a number is generated and played in a lottery. In order to have sufficient data for which to find previously drawn numbers, A player preferably collects several years worth of data on a "comparison lottery". The comparison lottery is preferably a lottery in which the drawn numbers are drawn in the same manner as the lottery to be played by the player. For example, if a player was preparing to select numbers for the Georgia lottery, the player may collect data on the Georgia and Illinois lotteries to be used as a reference. Because the drawing of lottery numbers is public information the drawn numbers of a lottery and the corresponding date of the draw may be recorded into a database for quick retrieval. In addition, such information is available on the internet, such as lottery.com. Although such information is preferably stored in a computer for efficient access, use of a computer is not necessary to practice the invention.

FIG. 1 is a block diagram of a preferred embodiment of the invention. A device 100 has a computer 102. The computer may be connected to a central computer or group of interconnected computers such as the internet, via a communications link. Software for accepting a number input by a user is provided and accessing databases. As shown in FIG. 1, a computer includes a display device 112 such as an LED, CRT, or other type monitor, an input device 110, and a computing device 116. The display 112 displays the resulting numbers generated from the input. The computer has at least a memory which contains software and a microprocessor which executes the software. The computer also has means for accessing information such as that shown in databases 150 and 160. Database 150 contains numbers, N 905, previously drawn in a comparison lottery 200, with the corresponding date, d, of the draw as shown in Table 1. Database 160 contains information relating to time t of astronomical events E which corresponds with each date of database 150. FIG. 3 shows an example of historical data found in database 160 as well as Table 2 of FIG. 1. Although shown as separate databases in FIG. 1, databases 150, 160 could be combined into a single database containing all the above-mentioned information.

Input device 110 is any mechanism through with a player may input an input number(s), I. The input device 110 may be a touch sensitive screen, a card reader, a keyboard (as shown in FIG. 1), or any other device capable of receiving an inputted number. An output device 114, such as a printer, may be used for printing results from the computer in addition to display 112.

Figure 2:
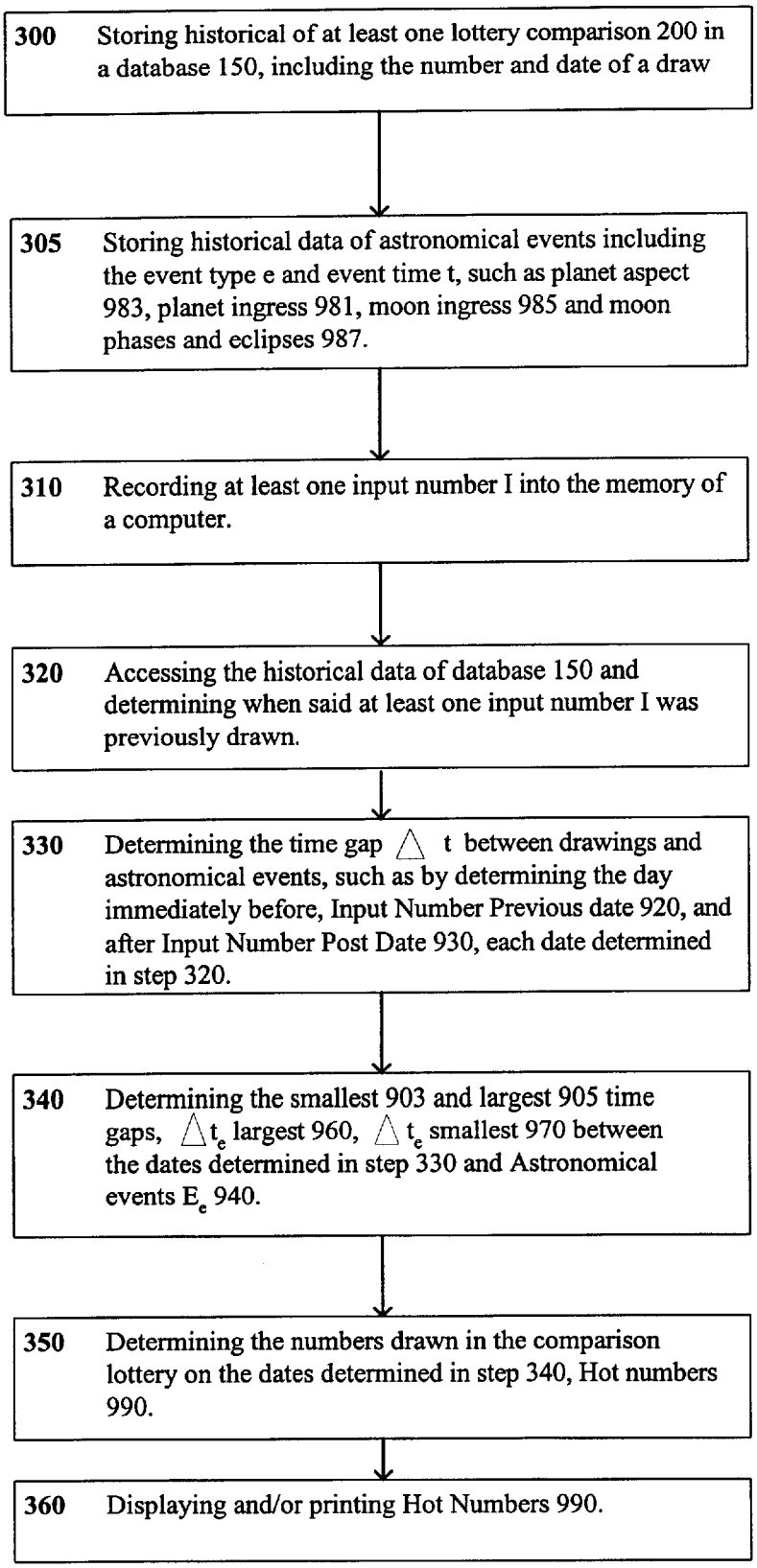
FIG. 2 is a Flow Diagram showing the steps of the invention.

Turn now to FIG. 2, which is a flow chart of the operation of the lottery number generating device. This operation is preferably implemented by the device 100. As shown by Step 300, historical data of a comparison lottery 200 is collected and stored in database 150 which is accessible by computer 102. This data contains at least the day d and number N of lottery draws for an historical period. As shown by step 305, data of astronomical events is collected and stored in database 160. This data includes the day and time of specified astronomical events. In the preferred embodiment it includes data on planet aspects, planet ingress, moon ingress, and phases and eclipses of the moon.

As shown by step 310 in FIG. 2, a player inputs at least one number, $I_n$, into the computer 102 by device 110. For instance, a user inputs an input number I, 900 into the computer 102 by keyboard 110. The display screen 112 may have an input screen instructing the user on how to input the number. For example purposes, assume input number 900 is the number 1-2-3.

In step 320, using historical data gathered from comparison lottery 200 stored in database 150, the days on which the input number 900 was previously drawn in comparison lottery 200 are then determined, $I_n$d 910. The number of days on which these numbers are known to have fallen depends upon the number of comparison lotteries used and the amount of historical data available to the player. Thus, more than a single comparison lottery may be used, including the lottery to be played by the player. A player may be provided with an option of which comparison lotteries to be used. For example, a player may choose to select only lotteries located in specific geographic regions, those with drawings at a particular time of day, or those that use a particular method.

The input number I 900 selected by the user may be chosen by various methods. For example, a person may select numbers recently drawn in the lottery to be played, such as numbers drawn in the previous two weeks. For example, if a player was planning to play the Cash 3 game in the Georgia Lottery then the player may input the numbers that had been drawn in the Georgia Lottery the previous 14 days. In addition, the player may be offered the ability to choose a comparison lottery from which the input number will be chosen. For example, a player could select the Florida lottery, and recently drawn numbers from the Florida lottery, such as the 7 most recently drawn numbers, could be used as input numbers I.

FIG. 3 shows a sample of previously drawn numbers N and their respective draw dates d for a comparison lottery 200. Using the number 1-2-3 chosen above and using FIG. 3 as the comparison lottery 200 it is seen that the number 1-2-3 was previously drawn on: October 10 and November $16^{th}$ of year X and February $24^{th}$ of year Y. Thus, in this example, for I=1-2-3, step 320 shows $I_n$d=October $10^{th}$ and November $16^{th}$ of year X and February $24^{th}$, December $2^{nd}$ and December $15^{th}$ of year Y.

| Dates Input Number 1-2-3 Previously Drawn |
|---|
| 10/10/X |
| 02/24/Y |
| 11/16/X |
| 12/02/Y |
| 12/15/Y |

In step 330 the time gap Δt 950 between previously drawn numbers and certain astronomical events is determined. In a preferred embodiment, the astronomical events that are used are planet ingress 981, planet aspect 983, moon ingress 985, and the moon phases and eclipses 987. An aspect is the relationship of the degrees of separation of two planets such as Mars and the moon for example. Generally, aspects are found when planets are at specific degrees to each other. For instance, the aspects of planets with the moon as used with the current invention are as follows:

Conjunction—when two planets are at the same degree of the same sign.

Sextile—when two planets are approximately 60 degrees apart

Square—when two planets are approximately 90 degrees apart

The trine—when two planets are approximately 120 degrees apart.

The opposition—when two plants are approximately 180 degrees apart.

In addition to the aspects of the moon, the ingress of the moon 985 into the signs of the zodiac is also used. The planet ingress 981 occurs when a planet enters a new sign of the zodiac. Thus, planets move between different aspects as there relative positions change.

The timing of these events are readily available in publication such as The American Ephemeris for the $21^{th}$ century by Neil F. Michelson. An ephemeris is a tabular statement containing astronomical data, an example of which is shown in FIG. 4. Such books are readily found in bookstores. Thus, a person can determine astronomical data on any particular day by locating the corresponding date on such an astronomical chart or ephemeris. In addition, the Planet Ingress, Last Aspect, Moon Ingress and the phases of the moon can be readily determined for any particular date. This information can then be stored in a database 160 for access by computer 102. For example, as seen in FIG. 4, which is an example of an ephemeris showing the data mentioned above, during January of year X Mercury enters the sign of Aquarius on the eight day of the month at 4:47 am; Mars is in the trine aspect with the moon on the second day at 12:34 am; and the moon enters the sign of Scorpio on the second day at 1:33 p.m. The time gaps are determined using a midnight ephemeris based upon Ephemeris Time. An example of a midnight ephemeris is shown in FIG. 4. In the preferred embodiment, the dates immediately before and after the dates found in step 320 are determined. These dates, $I_n$ Previous d 920 and $I_n$ Post d 930 are determined for each input number 900. In the current example, these dates would be February $23^{rd}$ and February $25^{th}$ of year two; October $9^{th}$ and $11^{th}$ of year one; and November $15^{th}$ and $17^{th}$ of year one as shown below.

| Date of Previous Draw | Date Prior to Previous Draw | Date Post Previous Draw |
|---|---|---|
| 02/24/X | 02/23/X | 02/25/X |
| 10/09/X | 10/08/X | 10/10/X |
| 11/16/Y | 11/15/Y | 11/17/Y |
| 12/02/Y | 12/01/Y | 12/03/Y |
| 12/15/Y | 12/14/Y | 12/16/Y |

In the preferred embodiment, the start or end of the day of each date 920, 930 is used as a reference point for measuring the time gap with the astronomical event e 940, depending on when the event occurs. For example, as shown in FIG. 4, the time of the conjunction aspect of Pluto during January of year X is 12:28 AM on January 7. Therefore, if January $8^{th}$ was the reference day the time gap would be measured from 12:00:01 am on January $8^{th}$ (the start of the day) back to 12:28 AM on January $7^{th}$ which would produce a time gap of 23 hours and 32 minutes. However, if the reference date was January $6^{th}$ then the time gap would be measured from 11:59:59 p.m. (the latest time on the 6) to the time of the event, 12:28 am on January 7, thereby producing a time gap 950 of only 28 minutes. However, other time measuring reference points could be used, such as using the time of the drawing of the lottery. For example, if the drawings of the comparison lottery 200 are performed at noon, then this time could be used as a reference point for measuring the time gap. The time gap is first measure from 12:00:01 am and measured to a first event which is either before or during the date. A second time gap measurement is made for the next occurrence of the event that occurs after the measuring date. For the $I_n$ Previous d 920 and $I_n$ Post d 930 in the example above, the time gaps are as follows. Thus, each day will have two time gaps.

| DATE | Planet Ingress Δt before-during/Δt after | | | Planet Aspect Δt before-during/Δt after | | | Moon Ingress Δt before-during/Δt after | | | Moon phases Δt before-during/Δt after | | |
|---|---|---|---|---|---|---|---|---|---|---|---|---|
| 02/23/X | 4 day | 1 hr | 16 min | 0 day | 2 hr | 16 min | 0 day | 7 hr | 46 min | 1 day | 20 hr | 28 min |
| | 0 days | 8 hrs | 7 min | 1 day | 13 hr | 36 min | 1 day | 18 hr | 7 min | 3 day | 2 hr | 1 min |
| 02/25/X | 0 day | 15 hr | 53 min | 0 day | 13 hr | 36 min | 0 day | 18 hr | 1 min | 0 day | 14 hr | 55 min |
| | 0 day | 3 hr | 45 min | 1 day | 14 hr | 55 min | 0 day | 16 hr | 4 min | 1 day | 2 hr | 19 min |
| 10/08/X | 3 day | 19 hr | 25 min | 0 day | 6 hr | 22 min | 0 day | 16 hr | 4 min | 0 day | 14 hr | 55 min |
| | 9 day | 1 hr | 10 min | 1 day | 23 hr | 14 min | 2 day | 1 hr | 32 min | 8 day | 20 hr | 3 min |
| 10/10/X | 5 day | 19 hr | 25 min | 0 day | 11 hr | 14 min | 1 day | 7 hr | 56 min | 2 day | 14 hr | 55 min |
| | 7 day | 1 hr | 10 min | 2 day | 5 hr | 3 min | 0 day | 1 hr | 32 min | 6 day | 20 hr | 3 min |
| 11/15/Y | 9 day | 6 hr | 34 min | 0 day | 22 hr | 41 min | 0 day | 11 hr | 34 min | 5 day | 23 hr | 46 min |
| | 5 day | 17 hr | 48 min | 0 day | 12 hr | 3 min | 0 day | 22 hr | 33 min | 0 day | 12 hr | 3 min |
| 11/17/Y | 11 day | 6 hr | 35 min | 0 day | 11 hr | 27 min | 0 day | 1 hr | 27 min | 1 day | 11 hr | 57 min |
| | 3 day | 17 hr | 48 min | 0 day | 20 hr | 9 min | 1 day | 10 hr | 40 min | 6 day | 17 hr | 37 min |
| 12/01/Y | 0 day | 14 hr | 6 min | 0 day | 0 hr | 2 min | 0 day | 18 hr | 0 min | 0 day | 19 hr | 15 min |
| | 6 day | 12 hr | 24 min | 1 day | 18 hr | 5 min | 2 day | 4 hr | 54 min | 5 day | 15 hr | 57 min |
| 12/03/Y | 1 day | 21 hr | 54 min | 0 day | 18 hr | 5 min | 1 day | 6 hr | 0 min | 1 day | 4 hr | 45 min |
| | 4 day | 12 hr | 24 min | 2 day | 3 hr | 48 min | 0 day | 4 hr | 54 min | 3 day | 15 hr | 57 min |
| 12/14/Y | 5 day | 11 hr | 36 min | 0 day | 3 hr | 0 min | 0 day | 0 hr | 1 min | 6 day | 8 hr | 3 min |
| | 3 day | 0 hr | 29 min | 1 day | 19 hr | 15 min | 2 day | 5 hr | 13 min | 1 day | 19 hr | 15 min |
| 12/16/Y | 7 day | 11 hr | 36 min | 0 day | 19 hr | 15 min | 1 day | 23 hr | 59 min | 0 day | 19 hr | 15 min |
| | 1 day | 0 hr | 29 min | 3 day | 2 hr | 47 min | 0 day | 5 hr | 23 min | 7 day | 21 hr | 40 min |

Once these time gaps are determined, as shown in FIG. 2 in step 340, the shortest 903 and longest 905 time gap is determined for each event. For the example above, these time gaps 903, 905 are shown below. These times are designated by $\Delta t_{elongest}$, $\Delta t_{e\ shortest}$ where e represents a variable for each one of the events. Thus, eight dates will be found (the shortest and longest for each of the four events of planet ingress, planet aspect, moon ingress, and moon phases).

| | Planet Ingress | Planet Aspect | Moon Ingress | Moon phases |
|---|---|---|---|---|
| Date of Smallest Δt | 02/23/X | 12/01/Y | 12/14/Y | 11/15/Y |
| Date of Largest Δt | 11/17/Y | 10/10/X | 02/25/X | 10/08/X |

As shown in step 350, of FIG. 2, the corresponding number drawn on each date determined in step 340 is then determined, these numbers are Hot Numbers 990. Determining the Hot Numbers 990 may be done by searching database 150 on the key d matching the dates determined in step 340 and determining the corresponding Drawn Number, N 905. The Hot Numbers 990 for this example, using FIG. 3 are as shown below:

| | Planet Ingress | Planet Aspect | Moon Ingress | Moon phases |
|---|---|---|---|---|
| Hot Number smallest time gap | 8-4-0 | 2-8-7 | 4-5-9 | 2-8-5 |
| Hot Number Largest time gap | 4-0-4 | 4-6-5 | 1-5-9 | 5-8-3 |

As shown in step 360 these dates are then displayed on the computer screen as shown in FIG. 5. Alternatively the generated numbers could be printed out on a paper or the like and used as a Hot Sheet 995 as show in FIG. 7. The Hot Sheet 995 may then be sold to others or be used by a player playing a lottery. Because more than a single number is generated, the player may elect to play each number on the Hot Sheet 995. However, the player may elect to play only one of the numbers generated, such as the number associated with the smallest time gap or the player may elect to play the numbers for one of the particular events.

Although not necessary for practicing the method of the invention, the aforementioned steps are preferably performed by the device 100. Thus, the tables containing the information discussed above may be stored in computer memory such that it may be readily accessed by a user. In addition, instruction sets for use on a computer can be used to access the tables and perform the steps above. The computer 102 could be connected to the internet and access databases accessible online.

Figure 7:
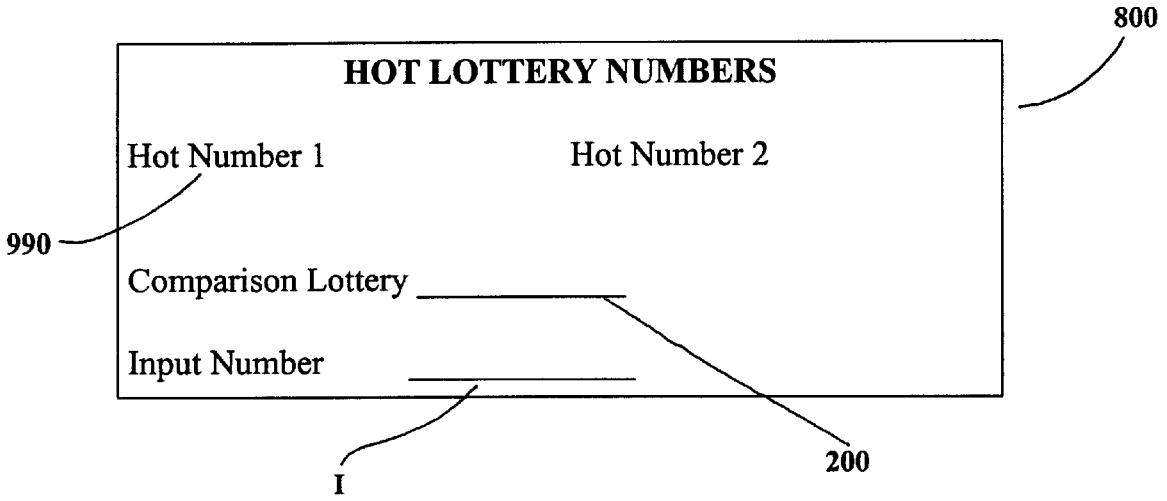
FIG. 7 shows a sample hot sheet generated on a printer.

In an alternative embodiment, combinations of the Input Number, I may be used computed and used. For instance, an additional step 315 is performed which determines each combination of the Input Number, I for use in step 320. This additional step increases the numbers used in step 320. Furthermore, the display or printout of a Hot Sheet 800, as shown in FIG. 7 may display the Hot Numbers 990, as well as the comparison lottery 200 chosen by the player and the Input Number I 900, used to generate the Hot Sheet. The Hot Sheet 800 may be sold to others so that the Hot Numbers 990 may be used for playing a lottery.

I claim:

1. A method of generating a number for play in a lottery comprising the steps of:

a. selecting at least one input number;

b. determining time when said at least one input number was previously drawn in a comparison lottery;

c. determining a time gap between time found in step b and at least one astronomical event;

d. using the time gap determined in step c to select from said comparison lottery at least one hot number;

e. displaying said at least one hot number to a user.

2. The method of claim 1, further comprising the step of printing said at least one hot number on paper.

3. The method of claim 1 wherein said at least one astronomical event includes moon ingress, aspects of planets, moon phases, and planet ingress.

4. A method for generating a predetermined amount of different numbers for use in a lottery game comprising the steps of:

a. recording previously drawn lottery numbers and their respective draw dates from at least one comparison lottery;

b. selecting at least one input number;

c. determining the dates on which said at least one input number was previously drawn in said at least one comparison lottery;

d. determining a time gap between the date determined in step c and at least one astronomical event;

e. selecting the shortest and longest time gaps determined in step d;

f. determining hot numbers corresponding to the dates found in step e; and g. displaying the hot numbers found in step f.

5. The method of claim 4 further comprising after step a the step of selecting said at least one comparison lottery from a plurality of comparison lotteries.

6. The method of claim 4 wherein said at least one astronomical event includes moon ingress.

7. The method of claim 4 wherein said at least one astronomical event includes aspects of planets.

8. The method of claim 4 wherein said at least one astronomical event includes moon phase.

9. The method of claim 4 wherein said at least one astronomical event includes planet ingress.

10. The method of claim 4 wherein said at least one astronomical event includes moon ingress, aspects of planets, moon phases, and planet ingress.

11. A method for generating a number for play in a lottery game from data acquired from previous lottery drawings said process comprising the steps of:

a. recording in memory the pool of raw data of previously drawn lottery numbers of at least one lottery and the respective astronomical conditions during such previous drawings;

b. using computer-operated means to determine dates recently drawn numbers have been previously drawn from the recorded data to determine the shortest time interval between the at least one astronomical event and the date of the drawing; and c. displaying the corresponding number drawn on said date of said at least one lottery determined in step b.

12. A device for generating numbers to by played in a lottery, comprising:

an input means for receiving at least one input number;

a computing means for recording said at least one input number into a computer, determining time when said at least one input number was previously drawn in at least one comparison lottery, determining time gaps between time said at least one input number was previously drawn and astronomical events, and using said time gaps to select from numbers previously drawn in said at least one comparison at least one hot number; and a display means for displaying the generated number.

13. The device of claim 12 further comprising a printing means for printing said at least one generated number.

* * * * *